United States Patent [19]

Spinner et al.

[11] 4,278,956

[45] Jul. 14, 1981

[54] HF-ATTENUATOR

[75] Inventors: Georg Spinner, Feldkirchen-Westerham; Leo Treczka, Munich, both of Fed. Rep. of Germany

[73] Assignee: Spinner GmbH Elektrotechnische Fabrik, Fed. Rep. of Germany

[21] Appl. No.: 46,634

[22] Filed: Jun. 8, 1979

[30] Foreign Application Priority Data

Jun. 14, 1978 [DE] Fed. Rep. of Germany ..... 2826081

[51] Int. Cl.[3] ..... H01P 1/22

[52] U.S. Cl. ..... 333/81 A; 333/22 R; 333/81 B

[58] Field of Search ..... 333/22 R, 22 F, 81 A, 333/81 B; 338/53, 55, 216

[56] References Cited

U.S. PATENT DOCUMENTS

| | | | |
|---|---|---|---|
| 2,412,462 | 12/1946 | Marsten | 338/55 |
| 2,875,418 | 2/1959 | Rolfs | 333/81 B |
| 3,309,634 | 3/1967 | Wheeler et al. | 333/22 R X |
| 3,916,352 | 10/1975 | Powell | 333/81 B X |
| 4,156,215 | 5/1979 | Stager | 333/22 R X |

*Primary Examiner*—Paul L. Gensler

*Attorney, Agent, or Firm*—Ostrolenk, Faber, Gerb & Soffen

[57] ABSTRACT

The disclosure concerns an HF attenuator for a hollow waveguide or a coaxial conductor. A rod of dissipative ceramic material is disposed along the length of the attenuator, so that moving along the length of the attenuator, the ceramic material increasingly defines or replaces at least one wall of the hollow waveguide or at least one of the two opposite sides of the coaxial conductor. A coolant passage may be provided along the rods of ceramic material. The ceramic material may take other forms, such as leaves and annular rings. In another embodiment for use in a waveguide, at least one wall of the longitudinal opening through the waveguide is defined by ceramic leaves, whose extent of projection into the opening is varied for HF attenuation.

32 Claims, 9 Drawing Figures

HF-ATTENUATOR

Figure 1:
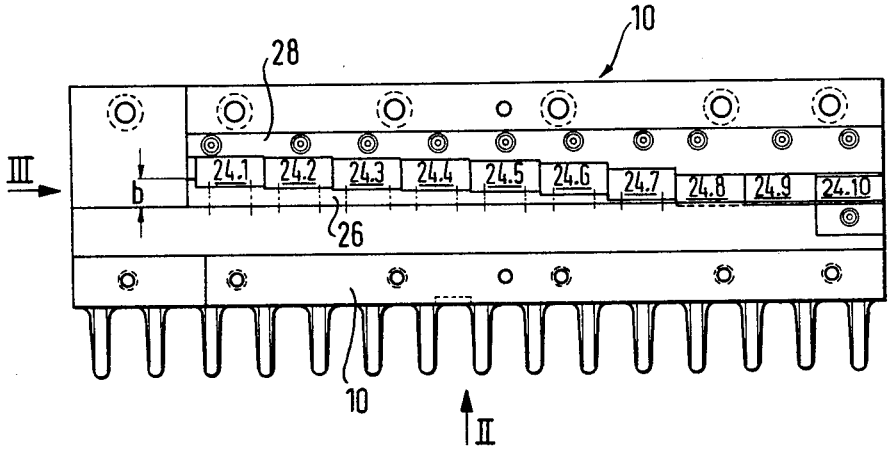

The invention relates to an attenuating member of the type particularly used for hollow waveguides. Known attenuating members, which may also be constructed as terminating impedances, or power resistive attentuators closing one end of an HF waveguide, employ as resistance material for example carburized insulating parts which can be adapted relatively easily in their form to the desired attenuation or absorption characteristic. Although this absorption material can be relatively simply worked and thus brought into the desired form, it has a low thermal stability. It is also known to use as absorption composition mixtures of cement, coal and metal or ceramic materials. However, with all these attenuating members there is the problem of heat dissipation. It is found that local heating of the resistance material occurs until red hot, in particular at areas converging to a point, whereas at other areas the heating is far less and this results in a poor average utilization.

The problem underlying the invention is to provide an attenuating member in which as resistance material ceramic material is used which is pressed in a geometrically simple form but nevertheless guarantees per unit length a substantially equal energy absorption and permits favourable dissipation of the heat generated.

This problem is solved by using a composition for the energy absorption material which has a substantially uniform thickness over the entire length of the absorber section. Furthermore, the absorption composition at least partially defines the hollow waveguide walls or the outer conductor of a coaxial line. Rods of dissipative ceramic material may be provided which extend over the entire length of the absorber and are disposed at a suitable inclined position to the axis so that they increasingly define or replace at least one wall of the hollow waveguide or in coaxial lines of the outer conductor, but preferably two opposite walls thereof. These long rods may be provided with a coolant passage, giving a particularly favourable dissipation of the heat so that it is even possible to dispense with cooling ribs. Water may for example be used as coolant.

According to a further development of the invention, the absorption composition consists of dissipative ceramic leaves of the same shape and size which are disposed in the energy propogation direction in step-like manner so that each following step of each leaf represents a greater portion of the hollow waveguide wall. By different step heights a very good approximation can be obtained to the ideal exponential form. These ceramic leaves in the form of short height cuboids consist preferably of dissipative silicon carbide and are clamped between correspondingly formed step strips of metal and mounted together with the latter on the divided base body. This base body consists according to a further development of the invention of two base halves which are substantially U-shaped in cross-section and are provided with cooling ribs. With an arrangement of a corresponding number of attenuating members and formation of the final member as absorber, such an attenuating member can advantageously form a terminating impedance in which the heating per unit length is substantially equal so that a particularly favourable utilization is possible.

The leaves of ceramic material used may be used relatively simply and it has been found that when using correspondingly small leaves and step intervals about $\lambda/4$ long an energy absorption is obtained which is adequately uniform for practice. The step jumps may correspond substantially to the number of cooling ribs used. As a result, each step gives an attenuation of ten dB. In this manner, for example, a terminating impedance of 2 KW having ten steps can absorb 200 watts of energy in each step.

In attenuating members which are made as coaxial conductors the material absorbing the energy may also be made annular, successive rings being enclosed by the outer conductor and having either different diameters or different lengths.

However, in the manner described above with regard to a hollow waveguide, instead of rings leaves may be used which are disposed in step manner. In this case, the outer conductor of the coaxial conductor is conveniently made square and in any case the absorption material forms at least part of the inner wall facing the cavity.

When using coaxial conductor attenuating members as well quadratic or rectangular ceramic rods may be employed which with a square shape of the outer conductor in the energy propagation direction increasingly form the outer wall of the cavity and are surrounded by the outer conductor. These rods are also preferably traversed by coolant passages.

When using continuous rods, with the formation as terminating impedance, a separate absorber must be provided in the last stage and this may be again formed by ceramic sheets which are shaped in suitable manner and disposed empirically so that the desired absorption is ensured. With the construction as hollow waveguide such a leaf penetrates preferably from the wide side into the rectangular conductor cross-section as far as is necessary on the basis of empirical determination. The arrangement made conveniently being such that a conical form of the hollow waveguide results, as apparent from the drawings explained hereinafter.

Figure 3:
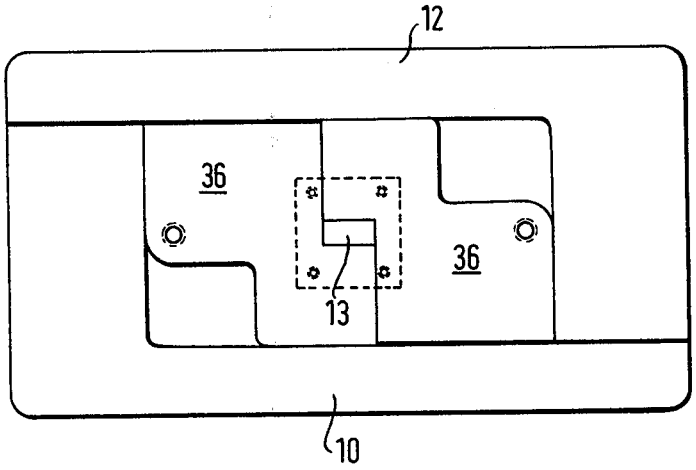
Figure 2:
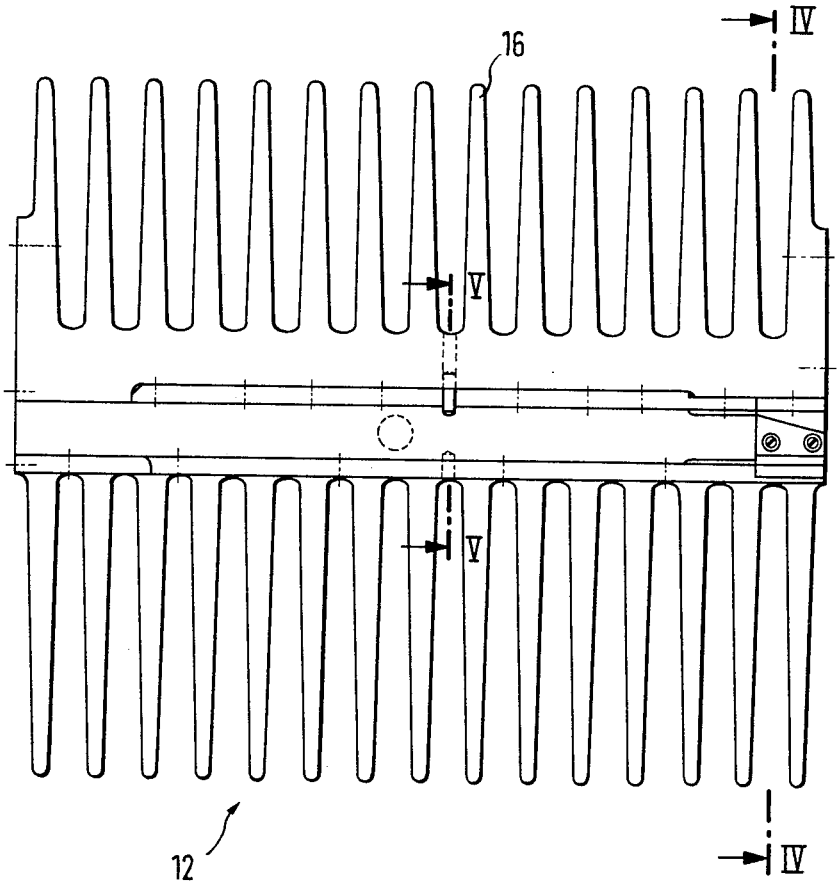
Figure 4:
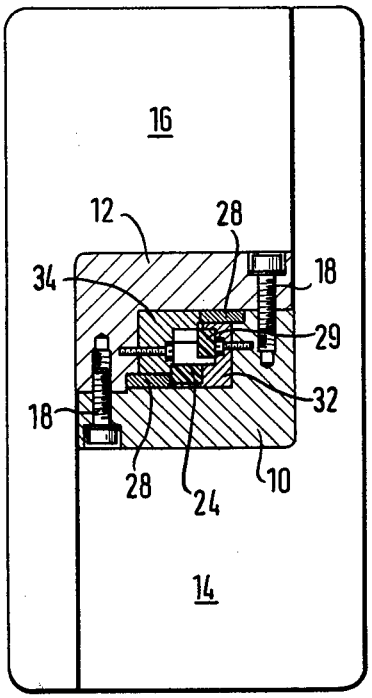
Figure 5:
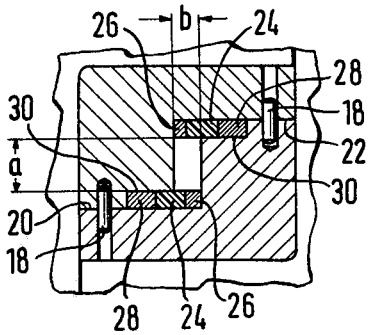
Figure 6:
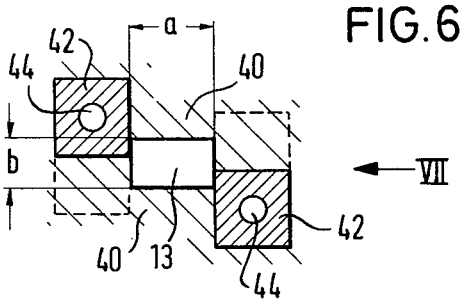
Figure 7:
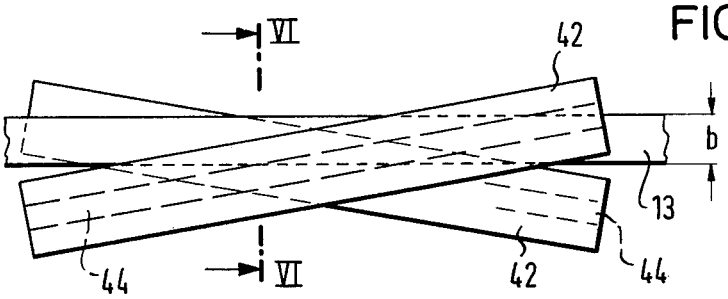
Figure 8:
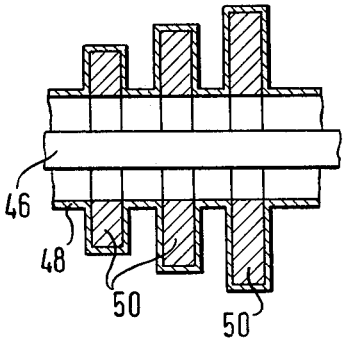
Figure 9:
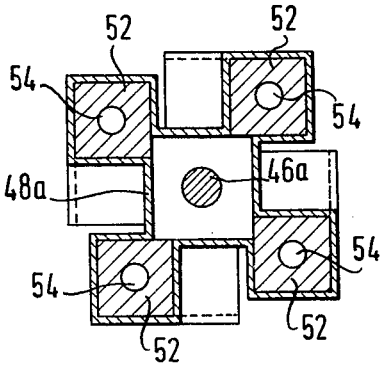

Examples of embodiment of the invention will be explained hereinafter with the aid of the drawings, wherein:

FIG. 1 is a plan view of one of the two mirror-symmetrical halves forming a terminating impedance, the plane of the drawing running parallel to the planes of the two narrow sides (i.e. the vertical sides in FIG. 3) of the rectangular hollow waveguide, FIG. 2 is a view of the other half of the terminating impedance in the direction of the arrow II of FIG. 1 (the half in FIG. 2 being imagined in a position in which it is operatively assembled with the half according to FIG. 1), FIG. 3 is an end elevation in the direction of the arrow III of FIG. 1 (both halves being assembled), FIG. 4 is a section along the line IV—IV of FIG. 2 (assuming that both halves are assembled), FIG. 5 is a section along the line V—V of FIG. 2 (assuming that both halves are assembled to form the terminating impedance), FIG. 6 is an axial view of a terminating impedance or attenuating member with water-cooled rods of ceramic material, FIG. 7 is a view in the direction of the arrow VII of FIG. 6, FIG. 8 is a schematic axial section of a coaxial conductor terminating impedance according to the invention with ceramic rings, FIG. 9 is a coaxial conductor terminating impedance with square outer conductor and water-cooled ceramic rods.

The attenuating member according to FIGS. 1 to 5 constructed as terminating impedance consists of two mirror-symmetrical base halves 10 and 12 of substantially L-shaped cross-section. Both halves have cooling ribs 14 and 16 respectively which project on two sides and in the assembled state (cf. for example FIG. 4) join to form annular cooling ribs. The body halves are fixedly connected together by screws 18 which are led through the division planes 20, 22 which extend parallel to the plane of the drawing according to FIG. 1 and parallel to the narrow sides of the rectangular hollow waveguides. This continuous rectangular hollow waveguide with the rectangular cross-section 13 is shown in FIGS. 3 to 5. The greater rectangular side a is defined by the two body halves 10 and 12 whilst the narrow rectangular sides b are formed by insert bodies or ceramic sheets in the manner described hereinafter.

As attenuating composition or absorption composition dissipative ceramic leaves 24, each having the form of a short height cuboid and ten of which, $\mathbf{24}_1$ to $\mathbf{24}_{10}$, being shown in FIG. 1, are arranged staggered in stepwise manner in series so that in the direction of the energy propogation the leaves 24 project progressively deeper into the wide side, i.e. form progressively an increasing portion of the narrow rectangle side b.

In the example of embodiment illustrated the ceramic leaves 24 form the narrow sides of the rectangular hollow waveguide; instead of this, and/or possibly additionally, ceramic leaves may be provided which progressively form a greater part of the wide side a of the rectangular hollow waveguide.

As apparent from FIG. 1, the steps are not equal, the increments becoming increasingly deeper in the energy propagation direction corresponding to an approximation to the ideal exponential function.

The ceramic leaves $\mathbf{24}_1$ to $\mathbf{24}_{10}$ are each embedded between two step-like metal strips 26, 28 which as apparent from FIG. 1 are screwed to the wall defining the major rectangular area or to the division plane 20, 22 of the body halves 10, 12. The ceramic leaves 24 are adhered between said stepped metal strips by means of a heat-resistant adhesive.

As apparent in particular from FIG. 5, the ceramic leaves and the step strips 26, 28, having the same thickness as the ceramic leaves, of the body half to which they are mounted lie in the division plane 20, 22. The respective opposite body half 12 or 10 has continuous parallel-flank recesses which accommodate these strips and ceramic leaves in so far as they do not form the narrow rectangle side b. This stepped recess is denoted by the reference numeral 30. The staggered arrangement of the ceramic leaves is such that the energy absorption in each step is about the same. Each step is then formed by the length of a leaf and the step length is about $\lambda/4$. In the example of embodiment illustrated ten leaves $\mathbf{24}_1$ to $\mathbf{24}_{10}$ are disposed in series so that with 200 watts absorption per step an energy absorption of 2 KW watts results. The terminal member $\mathbf{24}_{10}$ forms together with an additional leaf 29 projecting via the major rectangle side a into the rectangle cross-section 13 an absorber and special intermediate members 32 and 34 are provided which together with the metal strips 28 complete the hollow cross-section with the dimensions a and b and fill the space between the members 10 and 12. The members 32 and 34 are screwed to the body halves.

As apparent from FIG. 1, in the final member a reduced cross-section form of the hollow waveguide results because of the absorber member 29 used. The position and arrangement are determined empirically to guarantee the desired absorption.

FIG. 3 shows the connection end face of the terminal impedance with the flat contact face 36 to which the corresponding hollow waveguide portion is flanged.

FIGS. 6 and 7 show an attenuating member in which the rectangular cavity 13 is defined by a metal hollow waveguide wall 40 and bordered at the narrow sides partially by ceramic rods 42. The ceramic rods partially forming opposite rectangle narrow sides are, as shown in FIG. 7, inclined with respect to the axis of the hollow waveguide so that in the energy propagation direction the rectangle narrow side is increasingly defined by the rods. The rods 42 comprise a concentric passage 44 through which a coolant, in particular water, can flow, giving excellent heat dissipation which makes it possible to dispense with cooling ribs so that the attenuating member and a correspondingly constructed terminating impedance may be made extremely compact. If such an attenuating member according to FIGS. 6 and 7 is used as terminating impedance, the last absorber step, corresponding to the step $\mathbf{24}_{10}$ of FIG. 1, must be formed in the same manner as in the example of embodiment according to FIGS. 1 to 5, i.e. corresponding ceramic leaves must project into the hollow waveguide cross-section in an empirically determined manner.

FIG. 8 shows an axial section of a coaxial conductor attenuating member with inner conductor 46 and outer conductor 48. The air space is enclosed by rings 50 of ceramic material which in the energy propogation direction have a progressively greater outer diameter so that once again the desired adaptation results. The spacing of the rings 50 is preferably $\lambda/4$. Instead of rings of increasing diameter, rings of different width could be used, i.e. a width increasing in the energy propagation direction. The outer conductor 48 is led round the rings.

Alternatively, with rectangular, in particular square, formation of the coaxial outer conductor the stepwise arrangement of ceramic leaves may be as shown in FIG. 1 for the hollow waveguide attenuating member.

FIG. 9 shows a coaxial conductor attenuating member comprising an inner conductor **46*a* and a square outer conductor 48*a*, the four inner faces of the outer conductor being increasingly formed in the energy propagation direction by ceramic rods 52 which as in the example of embodiment of FIG. 7 are inclined with respect to the axis and each have a cooling water passage 54**. For adaptation of the wave resistance in the energy propagation direction in each cross-sectional area, the diameter of the inner conductor may increase correspondingly towards the line end.

We claim:

1. An HF attenuating member for a hollow waveguide, wherein the waveguide includes an elongate body having a longitudinal opening therethrough defined by an inner wall of the body;

resistance material disposed over the length of the body and at the inner wall, the resistance material being in the form of at least one body of constant cross-sectional dimensions, and the resistance material being shaped for increasing the proportion of the inner wall having absorbent properties in the direction of wave propagation and being shaped such that the energy absorption of the resistance material per unit of body length is substantially constant.

2. The HF attenuating member of claim 1, wherein the resistance material is shaped in the opening in the body for increasingly stepwise replacing the inner wall in the direction of wave propagation.

3. The HF attenuating member of claim 1, wherein the opening is shaped so that the inner wall thereof defines opposite sides of the opening; the resistance material replaces two opposite sides of the opening symmetrically, to an increasing extent in the direction of wave propagation.

4. The HF attenuating member of claim 3, wherein the opening is rectangular in shape; and the resistance material is located at the narrower opposite sides of the opening.

5. The HF attenuating member of claim 2, wherein the resistance material comprises a row of dissipative ceramic material leaves, each being of identical shape and size, and the leaves being disposed in the wave propagation direction stepwise in a manner such that in each successive step each leaf defines and provides a greater proportion of the inner wall.

6. The HF attenuating member of claim 5, wherein at least some of the leaves are held by the body so as to be partially outside of the body opening, for establishing the respective portion of the inner wall that is provided by the respective leaf.

7. The HF attenuating member of claim 5, wherein the portion of the inner wall that is provided by each leaf is selected such that each leaf withdraws the same energy portion from the waveguide.

8. The HF attenuating member of claim 5, further comprising respective metal strips at the inner wall for supporting each ceramic leaf; the inner wall at each ceramic leaf being defined by that ceramic leaf and by a respective metal strip for that ceramic leaf.

9. The HF attenuating member of claim 8, wherein the waveguide is comprised of two symmetrically converging body halves of generally L-shaped cross-section, and the body halves being respectively shaped and placed for together defining the body opening between the body halves; at the body opening, the body halves having recesses for reception of the metal strips and the ceramic leaves.

10. The HF attenuating member of either of claims 5 or 7, wherein the axial length along the body of each ceramic leaf is $\lambda/4$.

11. The HF attenuating member of claim 9, wherein the ceramic leaves are adhered in a heat resistant manner to the body halves and the metal strips.

12. The HF attenuating member of either of claims 1 or 5, wherein the attenuating member includes a terminating impedance at the end of the body in the direction of wave propagation and for the terminating impedance, in the body opening, there is both a ceramic leaf and a final attenuating leaf, such that the entire residual energy is absorbed at the end of the body.

13. The HF attenuating member of claim 12, wherein the final attenuating leaf is so shaped and placed as to reduce the cross-section of the body opening.

14. The HF attenuating member of claim 13, wherein the body opening is rectangular in cross-section and the final attenuating leaf reduces the width of the wide side of the body opening.

15. The HF attenuating member of claim 1, wherein the resistance material has coolant flow passages defined through it.

16. The HF attenuating member of claim 1, wherein the resistance material comprises a rod on one side of the opening of the body and being inclined to the axis of the body; and in the direction of wave propagation, the rod being placed for increasingly replacing the inner wall of the opening.

17. The HF attenuating member of claim 16, wherein the resistance material comprises two of the rods, each on a respective side of the opening, and the rods being symmetrically arranged, and each rod increasingly replacing the respective side of the inner wall of the opening.

18. The HF attenuating member of claim 17, wherein each rod is inclined to the axis of the body in the opposite direction of inclination from the other rod.

19. The HF attenuating member of either of claims 16 or 17, wherein each rod is of approximately square cross-section.

20. The HF attenuating member of either of claims 16 or 17, wherein each rod has a coolant flow passage defined through it.

21. The HF attenuating member of claim 20, wherein the coolant flow passage occupies the center part of each rod.

22. An HF attenuating member for coaxial conductors, which conductors include an inner conductor and a hollow tubular outer conductor around the inner conductor;

resistance material being disposed over the length of the conductors and at the inner wall of the outer conductor, the resistance material being in the form of at least one body of constant cross-sectional dimensions, and the resistance material being shaped for increasing the proportion of the inner wall having absorbent properties in the direction of wave propagation and being shaped such that the energy absorption of the resistance material per unit of conductor length is substantially constant.

23. The HF attenuating member of claim 22, wherein the outer conductor generally has a square cross-section; the resistance material comprises a rod of resistance material which is oriented obliquely to the axis of the conductors and the rod being placed for increasingly being within the square cross-section of the outer conductor in the direction of wave propagation; and the outer conductor passing around the rod.

24. The HF attenuating member of claim 23, wherein the resistance material comprises a plurality of the rods of resistance material, located at different respective sides of the outer conductor.

25. The HF attenuating member of either of claims 23 or 24, wherein each rod has a coolant flow passage defined through it.

26. The HF attenuating member of either of claims 23 or 24, wherein each rod is of square cross-section.

27. The HF attenuating member of claim 24, wherein there is a respective one of the rods for each of the four sides of the outer conductor.

28. The HF attenuating member of either of claims 23 or 24, wherein each rod is comprised of ceramic material.

29. The HF attenuating member of either of claims 24 or 27, wherein the diameter of the inner conductor gradually increases in the direction of wave propagation.

30. An HF attenuating member for coaxial conductors, which conductors include an inner conductor and a hollow tubular outer conductor around the inner conductor;

resistance material being disposed along the length of the conductors and at the inner wall of the outer conductor, wherein the resistance material comprises a series of axially arrayed and spaced apart rings of resistance material which in the direction of wave propagation have a progressively greater amount of resistance material, and the resistance material rings being shaped for increasing the absorbent properties of the resistance material in the direction of wave propagation, such that the energy absorption of the resistance material per unit length of the conductors is substantially constant;

the outer conductor passes along and is spaced out from the inner conductor and also passes around the outside of each ring as the outer conductor encounters each ring.

31. The HF attenuating member of claim 30, wherein the rings have a progressively greater amount of resistance material by having a progressively greater outer diameter while being of substantially constant axial width.

32. The HF attenuating member of claim 30, wherein the rings are spaced apart about $\lambda/4$.

* * * * *